US006471468B1

(12) United States Patent
Hartmann

(10) Patent No.: US 6,471,468 B1
(45) Date of Patent: Oct. 29, 2002

(54) COMPENSATOR

(75) Inventor: Harald Hartmann, Kindenheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 09/830,804

(22) PCT Filed: Sep. 28, 1999

(86) PCT No.: PCT/EP99/07182

§ 371 (c)(1),
(2), (4) Date: Apr. 30, 2001

(87) PCT Pub. No.: WO00/26542

PCT Pub. Date: May 11, 2000

(30) Foreign Application Priority Data

Oct. 30, 1998 (DE) ..... 298 19 363

(51) Int. Cl.[7] ..... F01D 25/26
(52) U.S. Cl. ..... 415/135
(58) Field of Search ..... 415/134, 135, 415/199.1–199.3, 214.1, 912

(56) References Cited

U.S. PATENT DOCUMENTS

| | | | | |
|---|---|---|---|---|
| 2,017,544 A | * | 10/1935 | McHugh | 415/134 |
| 4,098,558 A | | 7/1978 | Bush et al. | |
| 4,218,181 A | | 8/1980 | Komatsu et al. | |
| 4,244,675 A | | 1/1981 | Bower | |
| 5,456,577 A | | 10/1995 | O'Sullivan et al. | |

FOREIGN PATENT DOCUMENTS

| | | |
|---|---|---|
| DE | 516511 | 1/1931 |
| DE | 518 178 C | 1/1931 |
| DE | 689 618 C | 3/1940 |
| FR | 700 716 A | 3/1931 |
| GB | 316 503 A | 8/1929 |

* cited by examiner

*Primary Examiner*—Edward K. Look
*Assistant Examiner*—Dwayne J. White
(74) *Attorney, Agent, or Firm*—Crowell & Moring LLP

(57) ABSTRACT

The invention relates to a compensator modular unit for a multistage pump housing, ensuring as compensation device during hot or cold temperature shocks compensation of changes in length caused by said shocks.

7 Claims, 2 Drawing Sheets

COMPENSATOR

Figure 1:
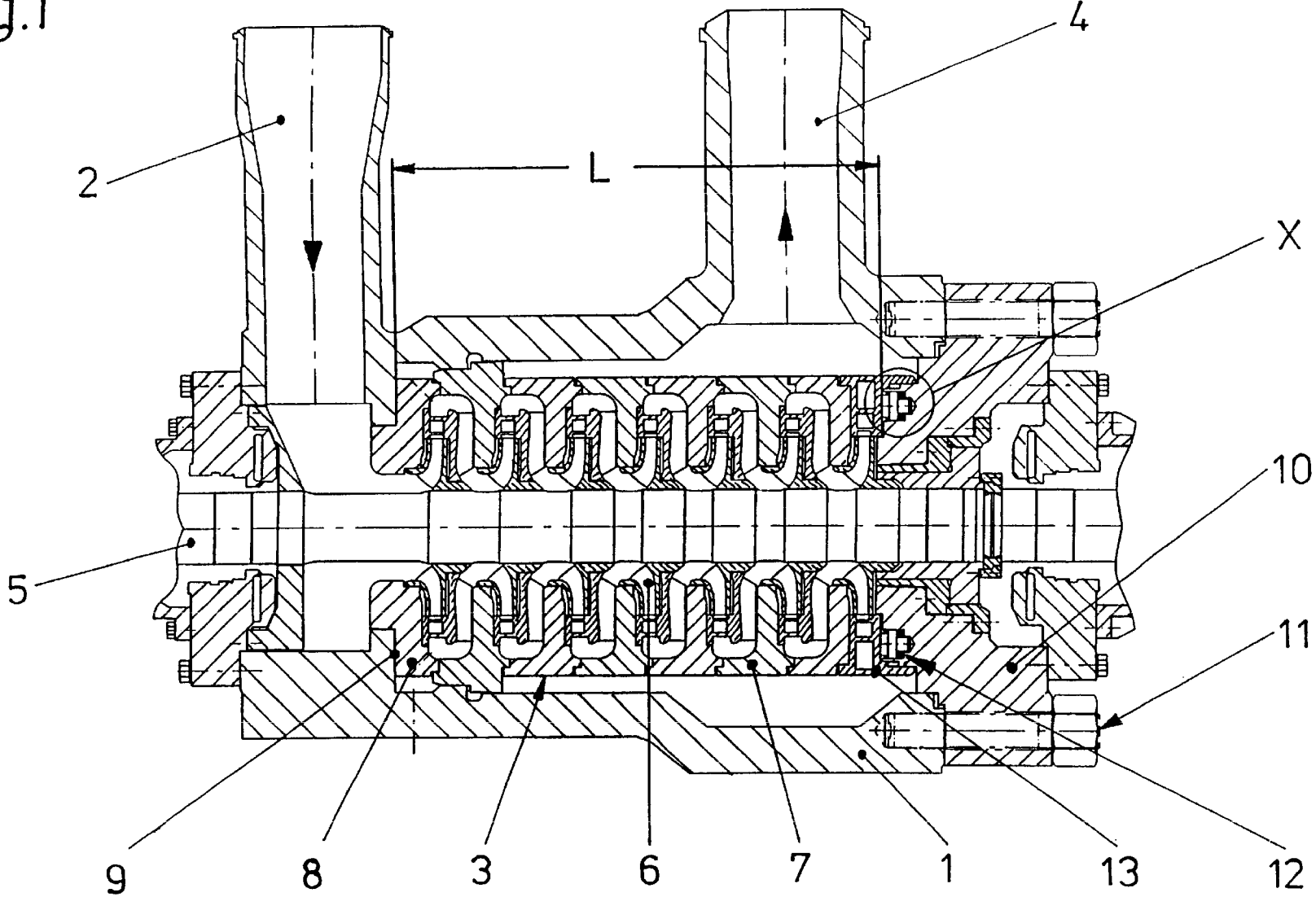

The invention relates to a multistage centrifugal pump with a pump housing having an inlet and an outlet. A plurality of stage housings are arranged in the pump housing, each stage housing having an impeller and a guide vane system. The stage housings, together with a pump shaft, are designed as a withdrawable pump unit. A compensating device is arranged within the pump housing to compensate changes in axial length of the withdrawable pump unit.

U.S. Pat. No. 5,456,577 discloses a compensating device in the form of a compensator for multistage centrifugal pumps. To this end, on the last stage housing subject to flow, a wall area extending radially to the shaft is designed as a disk spring. This spring action is intended to compensate any change in length that occurs during pump operation and standby operation. This type of compensator requires very special and costly production of the last stage housing, or of the guide vane system of the last pump stage. Due to the use of only a single disk spring, there is a risk of material fatigue during prolonged operation. Furthermore, such a solution is ineffective when a pump thus equipped is subjected to an overhaul. During the overhaul work, the support surface or sealing surface of an individual stage housing is frequently reworked, which causes the entire length of a withdrawable pump unit formed of a plurality of stage housings to be shortened. As a result the force of the disk spring element of the last pump stage is negatively affected.

U.S. Pat. No. 4,098,558 discloses assembly aids for a withdrawable pump unit for the foregoing type of pump. To assemble it, the stage housing parts located on the pump shaft are biased against one another by means of the assembly aid.

An individual large disk spring designed as a separate component generates the biasing forces between the discharge-side housing cover, which seals the pump housing, and the last pump stage. After the withdrawable pump unit has been installed in the pump housing and the outer housing cover has been mounted, the assembly aids are dismantled. The disk spring then generates the necessary forces for the stage housing of the withdrawable pump unit. Such a large single disk spring is costly to produce, requires a substantial amount of work in the assembly of the interacting components, and has the disadvantages of the previously discussed solution.

The design described in U.S. Pat. No. 4,218,181 also requires special assembly means to enable a prestressed withdrawable pump unit to be inserted into the pump housing. A special type of lock effects locking between pump housing and housing cover. The individual disk spring used here is also costly to produce and involves the well-known risks regarding service life.

The object of the invention is to provide a compensation device which is easy to assemble and simple to produce, but ensures a reliable compensating effect in different operating states of a multistage centrifugal pump and assures the operability of the pump even after an overhaul. This object is achieved by the features of claim 1.

By constructing the compensating device in the form of a plurality of elastically resilient compensator modules, which are designed as multielement structural units, permits a substantially simpler adaptation of such a compensating device.

The use of a plurality of multi-element compensator modules, in which a plurality of elastically resilient compensator elements are disposed, has the advantage that smaller units are formed. This makes it possible to use commercially available compensator elements, which eliminates the costly production of specially designed compensator elements. The multi-element structure of the compensator modules provides the significant advantage that, if the pump is overhauled and the length of the withdrawable pump unit changes as a result, the change in length can be readily compensated by simply adding further compensator elements in the respective structural units. By distributing the compensator elements over a plurality of modules, the modules, depending on the design of the withdrawable pump unit, can be arranged at various locations. This permits simple adaptation of a standardized compensator module to pumps of various designs. Depending on the size of the withdrawable pump unit, which is a function of the number of stage housings used, the compensator modules can be arranged at the most suitable locations within a withdrawable pump unit.

According to one embodiment of the invention, the compensator modules are distributed over an surface area as well as arranged between a housing cover of the pump housing and a first or last stage or an impeller of the withdrawable pump unit. According to this solution, such a housing cover which seals the housing can be used for a plurality of pump housings of different lengths, so that only one housing cover is required for the housings of different pump sizes. The use of a standardized housing cover, which can be arranged on the inlet or the discharge side, or as an intermediate stage cover, easily simplifies the compensation of a change in the overall length in case of a temperature shock to which the pump is subjected.

A particularly effective design has proven to be one in which the compensator elements in the compensator modules are formed by a plurality of disk springs, which are arranged in the form of packets. In a single or multiple alternating arrangement of the compensator elements or disk springs in the corresponding compensator modules, the changes in length that occur due to the existing temperature loads can be compensated in the simplest manner.

To simplify the assembly of a pump equipped with such a compensating device, a further embodiment of the invention provides that the compensator elements, which are arranged in the form of packets, be guided in a holder and provided with load transmission means. The load transmission means serves to transfer the corresponding compensation forces to the withdrawable pump unit, or the stage housings or impellers forming the withdrawable pump unit. The compensator elements or disk springs can fit directly against one of the housing covers of the pump housing for simple support.

Guiding means hold the compensator elements arranged in the form of packets at their intended location. These means can be a housing cover, an impeller and/or a stage housing. Securing elements hold the compensator elements which are arranged in the form of packets, and/or the load transmission elements in their respective installed positions. This ensures substantially simpler handling during pump assembly. The compensator modules mounted at their intended location, e.g., a housing cover, are thus held positively in position. It has proven to be advantageous if the securing elements are positioned such that the compensating device is held in place prior to assembly of the pump housing. The necessary biasing forces are applied only when all the components are in position and the pump housing is sealed by means of the clamping bolts. This ensures a simpler design of the securing elements and reduces the risk of accidents during assembly.

Any risk of injury during dismantling of the pump due to suddenly released compensator elements can also be reduced.

Figure 2:
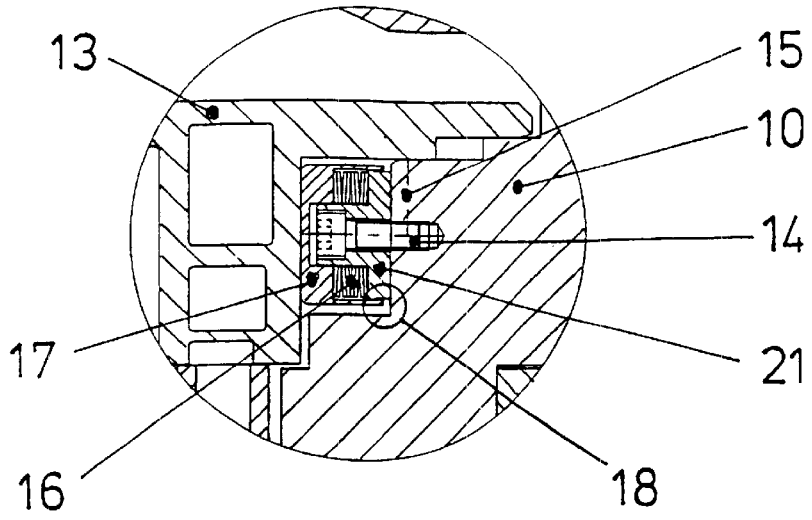
Figure 3:
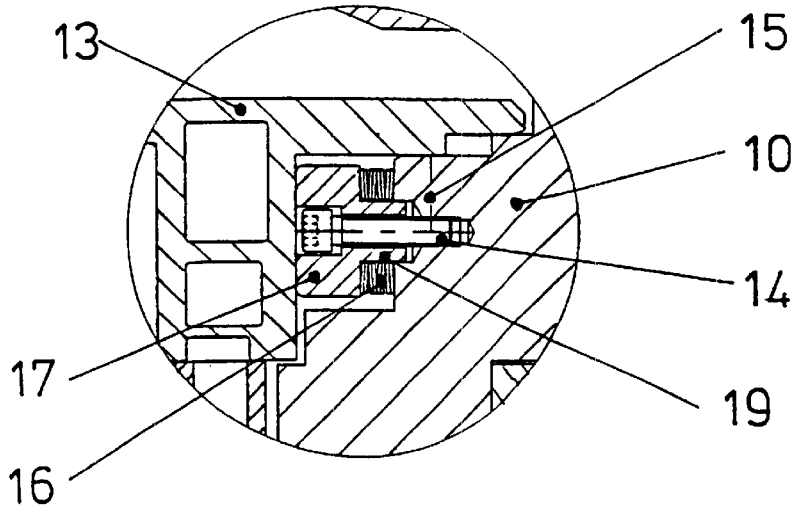
Figure 4:
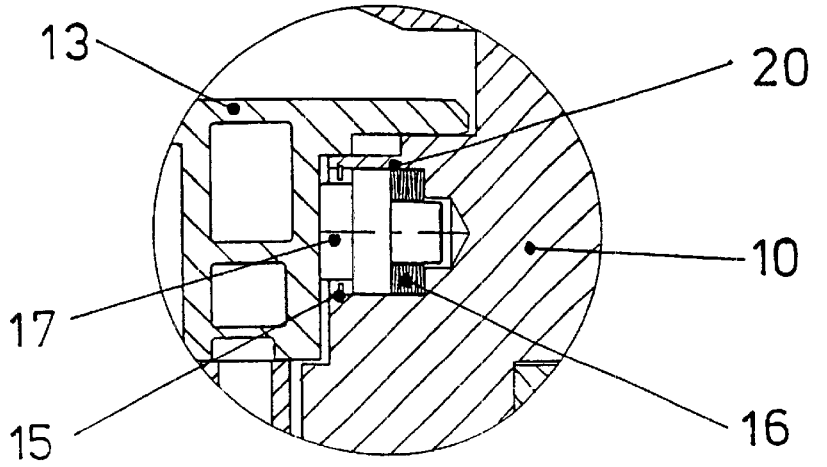

The invention will now be explained in greater detail, by way of example, with reference to the drawings in which FIG. 1 shows a multistage centrifugal pump, and FIGS. 2–4 show various compensator modules in cross section.

FIG. 1 shows a multistage centrifugal pump in cross section. The pump housing 1 depicted as a shell housing has an inlet 2 through which the pumping medium flows into the pump housing and is transported by the withdrawable pump unit 3 to the outlet 4. The withdrawable pump unit 3 comprises a shaft 5 on which a plurality of impellers 6 with associated stage housings 7 are arranged. An inlet-side cover 8 of the withdrawable unit 3 fits against a shoulder 9 within the housing. The housing 1 is sealed by a discharge-side housing cover 10 formed by connecting means 11, which in this case are stud bolts with associated nuts.

The compensator modules 12, in this case a plurality thereof, are held in housing cover 10. They transmit the load to the last impeller 13 of a stage housing or pump stage in flow direction of the withdrawable pump unit 3. A compensator module 12 is identified as an individual unit by circle X. Enlargements thereof are described in greater detail in FIGS. 2 to 4.

Length L shown between inlet 2 and outlet 4 corresponds to the overall length L, which is determinative for the change in length of the withdrawable pump unit 3. Based on this, in case of a hot or cold temperature shock, the respective change in length $\Delta L$, which must be compensated by the compensator module 12, is calculated.

FIGS. 2 to 4 show various embodiments of possible compensator modules 12. FIG. 2 shows a compensator module 12 in which an abutment 21 is held in housing cover 10 by fastening means 14, in this case a bolt. Fastening means 14 is held in position with the aid of securing means 15 corresponding to the known securing means and shown as a broken line. The abutment 21 serves to guide and support compensator elements 16, which in this case take the form of disk springs that transfer their force to a load transmission element 17.

In the embodiment shown in FIG. 2 the load transmission means 17 is cupshaped and its bottom surface fits against the last impeller 13 of the withdrawable pump unit. Along its open rim it is equipped with one or more beads, which engage corresponding recesses or projections of the abutment 17. Thus, a captive element 18 is formed, by means of which the load transmission element 17 snaps into the abutment 21 to ensure secure mounting of the compensator elements 16.

The embodiment shown in FIG. 3 is distinguished from the embodiment of FIG. 2 in that the abutment 21 has been eliminated. Instead, means 19, designed as a cylindrical shoulder, which forms part of the load transmission element 17 and has a mushroom-shaped cross section, guides the disk spring 18. The connecting means 14, here again in the form of a screw, connect all the parts of the compensator module with the housing cover 10. Securing means 15 serves as a safety lock with respect to connecting means 14.

The embodiment depicted in FIG. 4 shows another type of securing means 15 for the load transmission element 17. Both disk springs 16 and load transmission means 17 are guided in bores 20 of housing cover 10. On the side of the load transmission means 17 opposite the disk springs 16, load transmission means 17 is provided with a projection with a smaller diameter so that securing means 15 in the form of a securing ring can be placed into the space thus formed.

Such compensator modules can be arranged as preassembled elements in one or both housing covers and/or in one of the stage housings or in another component of the withdrawable pump unit. Depending on the magnitude of the forces to be applied, or depending on the magnitude of the change in length $\Delta L$ that occurs within the pump housing in case of a temperature shock, the spring force and the path of the compensator modules must be dimensioned so as to ensure a reliable fit of the individual stage housings of the withdrawable pump unit in the worst-case operating state. In a hot temperature shock, the entire pump is assumed to be cold and is abruptly subjected to a hot pumping medium. In consequence, the withdrawable pump unit through which the hot medium flows, expands very rapidly. This causes its overall length to increase. This increase in the overall length must be capable of being absorbed by the possible path length of the compensator module.

In a cold shock, the pump and its parts are hot and are suddenly supplied with cold pumping medium. In consequence, the withdrawable pump unit contracts and the compensator modules must ensure that, based on the biasing forces and the possible path length within the compensator modules, the shortening that occurs in the withdrawable pump unit can be compensated to ensure a constant tight fit of the individual stage housings.

What is claimed is:

1. A multistage centrifugal pump comprising a pump housing with an inlet and an outlet; a plurality of stage housings arranged within the pump housing, each stage housing having an impeller and a guide vane system; a pump shaft which together with the stage housings forms a withdrawable pump unit, and a compensation device comprising a plurality of multi-element compensator modules arranged in said pump housing between the pump housing and the withdrawable pump unit or within the withdrawable pump unit arranged to compensate for changes in axial length of the withdrawable pump unit; wherein each of the compensator modules has a plurality of elastically resilient compensator elements, and wherein the elastically resilient compensator elements are disk springs.

2. A centrifugal pump according to claim 1, wherein the compensator modules are distributed over a surface at right angles to the axis of the pump shaft and between a housing cover of the pump housing and a first or last stage or an impeller of the withdrawable pump unit.

3. A centrifugal pump according to claim 1, wherein said compensator elements comprise a plurality of disk springs arranged in the form of packets in the compensator modules.

4. A centrifugal pump according to claim 1, further comprising means for holding the compensator elements arranged in the form of packets to a housing cover, a stage housing or an impeller.

5. A centrifugal pump according to claim 1, further comprising securing means for holding the disk springs in position.

6. A centrifugal pump according to claim 1, wherein the compensator elements are arranged in the form of packets and are guided in a holder and provided with at least one load transmission element.

7. A centrifugal pump according to claim 6, further comprising securing means for holding the load transmission elements in position.

* * * * *